US007044192B2

(12) United States Patent
Dubay

(10) Patent No.: US 7,044,192 B2
(45) Date of Patent: May 16, 2006

(54) RUNNER COOLING BLOCK FOR DIE CASTING SYSTEMS

(76) Inventor: Richard L. Dubay, 11748 Crocus St., Coon Rapids, MN (US) 55733

( * ) Notice: Subject to any disclaimer, the term of this patent is extended or adjusted under 35 U.S.C. 154(b) by 0 days.

(21) Appl. No.: 11/147,091

(22) Filed: Jun. 7, 2005

(65) Prior Publication Data

US 2005/0274483 A1 Dec. 15, 2005

Related U.S. Application Data

(60) Provisional application No. 60/578,634, filed on Jun. 10, 2004.

(51) Int. Cl.
*B22D 27/04* (2006.01)

(52) U.S. Cl. ..... 164/312; 164/306; 164/348

(58) Field of Classification Search ..... 164/312, 164/306, 348
See application file for complete search history.

(56) References Cited

OTHER PUBLICATIONS

G.L. Wilson, "Improvements in the Hot Chamber Die Casting Process Through Hot-Sprue Technology". Available online, www.diecasting.asn.au/papers/2000C10.pdf.

D-M-E Company, "D-M-E Standard Runner Spreaders and Brushing Exclusively for Zinc Die Casting", *North American Digital Catalog*, pp. F-20-F-23.

*Primary Examiner*—Len Tran
(74) *Attorney, Agent, or Firm*—Kinney & Lange, P.A.

(57) ABSTRACT

A runner cooling block for use in a die casting system comprises a spreader block, a spreader, a bushing block, a sprue bushing and a water jacket. The sprue bushing comprises a sprue channel running through an interior of the sprue bushing and a cooling channel running circumferentially around an exterior surface of the sprue. The sprue bushing, water jacket and bushing block are assembled to allow cooling water to pass through the cooling channel. The spreader block and the bushing block are assembled such that the spreader is centrally located within the sprue channel wherein molten metal is allowed to pass through the sprue channel for passage into the runner system. The cooling channel includes at least one circumferential heat transfer contour to provide increased heat dissipation to enhance cooling of the molten metal passing through the sprue channel.

10 Claims, 7 Drawing Sheets

RUNNER COOLING BLOCK FOR DIE CASTING SYSTEMS

CROSS-REFERENCE TO RELATED APPLICATION(S)

The present application claims the benefit of provisional Application No. 60/578,634, filed Jun. 10, 2004 by Richard L. Dubay, entitled "Cooling Blocks for Molding and Casting Systems" according to 35 U.S.C. § 119(e), which is incorporated by reference in its entirety.

BACKGROUND OF THE INVENTION

Die casting is a popular method of forming articles of manufacture from zinc and magnesium alloys, especially for thin walled parts. Zinc and magnesium have relatively low melting points and are suited to both hot chamber die casting and cold chamber die casting. In hot chamber die casting, molten zinc or magnesium is pushed from a crucible, or pot, into a die casting system through a nozzle. The molten metal enters the die casting system through a sprue where it then travels through a runner system before entering the die cavity of a mold. The molten metal flows into the die cavity, where it solidifies and forms an article having a shape matching the die cavity. The solidified articles are then ejected from the mold, so that the process can be repeated. It is advantageous to cycle the molten metal through the runners and die cavity and then cool it down as fast as possible to keep cycle times down, and in turn keep production time and costs down.

One way to keep cycle times down is to control the temperature of the molten metal so that it enters the die at the optimal temperature to allow it to both flow through the runner system rapidly and cool rapidly. Temperature controlled sprue systems are commonly used to control the temperature and volume of molten metal that enters the runner system and the mold. In a temperature controlled sprue system, cooling fluid, such as water, is circulated through the inside of the die and around the sprue in order to remove heat from the die casting system that has been absorbed from the molten metal at the desired time, rate and location.

In these types of systems, a runner cooling block in which the sprue is located contains a system of channels for circulating cooling fluids through the runner cooling block very near where the molten metal enters the die at the sprue. This allows for control of the temperature of the molten metal as it enters the die casting system. When cooling fluid is circulated through the runner cooling block, heat from the molten metal is absorbed by the runner cooling block and dissipated by the cooling water. This reduces the time required to solidify the molten metal in the die cavity and the runner system, which in turn keeps cycle times down. However, conventional runner cooling blocks only provide limited levels of thermal dissipation. As such, there is a need for runner cooling blocks with improved thermal dissipation and heat transfer characteristics to reduce cycle times in die casting systems.

BRIEF SUMMARY OF THE INVENTION

A runner cooling block for use in a die casting system receives molten metal for distribution into a runner system of a die, and cooling fluid for transferring heat away from the molten metal passing through the runner cooling block. The runner cooling block comprises a spreader block having a spreader, a bushing block having a bushing seat and cooling water access holes, and a water jacket comprising a ring having cooling water holes. The runner cooling block also comprises a sprue bushing comprising a sprue channel running through an interior of the sprue bushing, a cooling channel running circumferentially around an exterior surface of the sprue bushing and having at least one circumferential heat transfer contour. The water jacket is positioned over the cooling channel such that the cooling water holes provide access to the cooling channel. The sprue bushing is situated in the bushing seat such that the access holes, the cooling water holes and the cooling channel are lined up to allow cooling water to pass through the cooling channel. The spreader block and the bushing block mate such that the spreader is centrally located within the sprue channel wherein molten metal is allowed to pass through the sprue channel for passage into the runner system.

DETAILED DESCRIPTION

Figure 1:
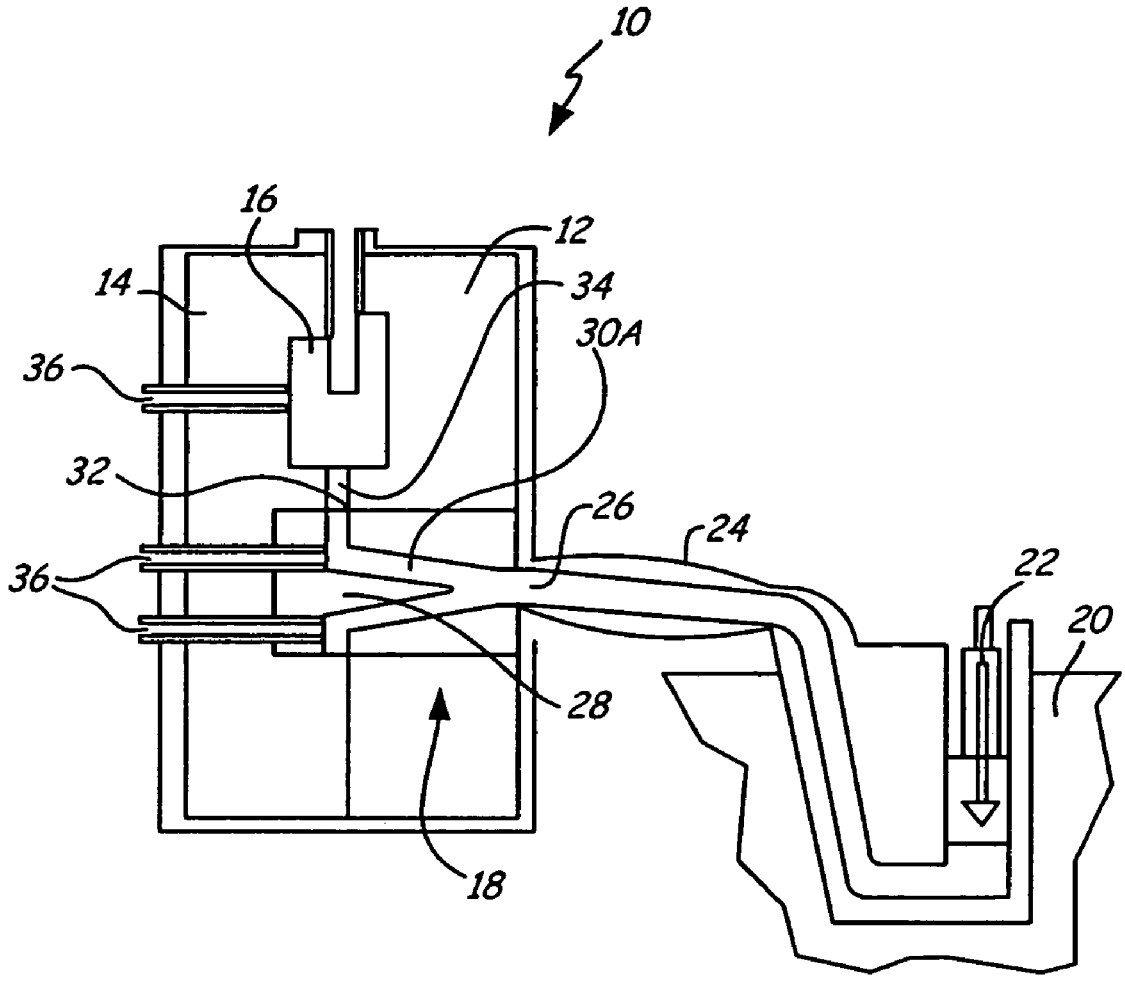
FIG. 1 shows a sectional view of a die casting system in which the present invention can be used.

FIG. 1 shows a sectional view of die casting system 10 in which the present invention is used. The invention is typically used in zinc or magnesium hot chamber die casting operations, and can also be used in cold chamber die casting operations. Die casting system 10 includes stationary die half 12 and moving die half 14. Stationary die half 12 and moving die half 14 together comprise mold cavity 16, which has the shape of an object that can be molded with die casting system 10. Die casting system 10 also includes runner cooling block 18, which is used to control the flow of molten metal into die cavity 16. Molten metal from crucible 20 is injected with piston 22 into die casting system 10 through nozzle 24 and sprue 26 of runner cooling block 18. As molten metal enters runner cooling block 18 through sprue 26, sprue post 28 directs the flow of the molten metal into runner 30A. Runner 30A directs flow of molten metal to outlet 32, into die runner 34 and into mold cavity 16. Runner cooling block 18, movable die half 14 and stationary die half 12 also include additional channels (not shown) for circulating cooling fluid, such as water, through runner cooling block 18 in order to control the temperature of the molten metal and, hence, its flow and cooling characteristics. Runner cooling block 18 provides improved heat dissipation for the injected metal as it enters die cavity 16, which accordingly reduces the cycle time required to cool the injected molten metal when creating articles of manufacture in die cavity 16. Once the molten metal is fully injected into die cavity 16 and properly cooled, movable die half 14 is pulled away from stationary die half 12 so that the cooled molten metal having the shape of die cavity 16 can be removed using ejectors 36.

Figure 2:
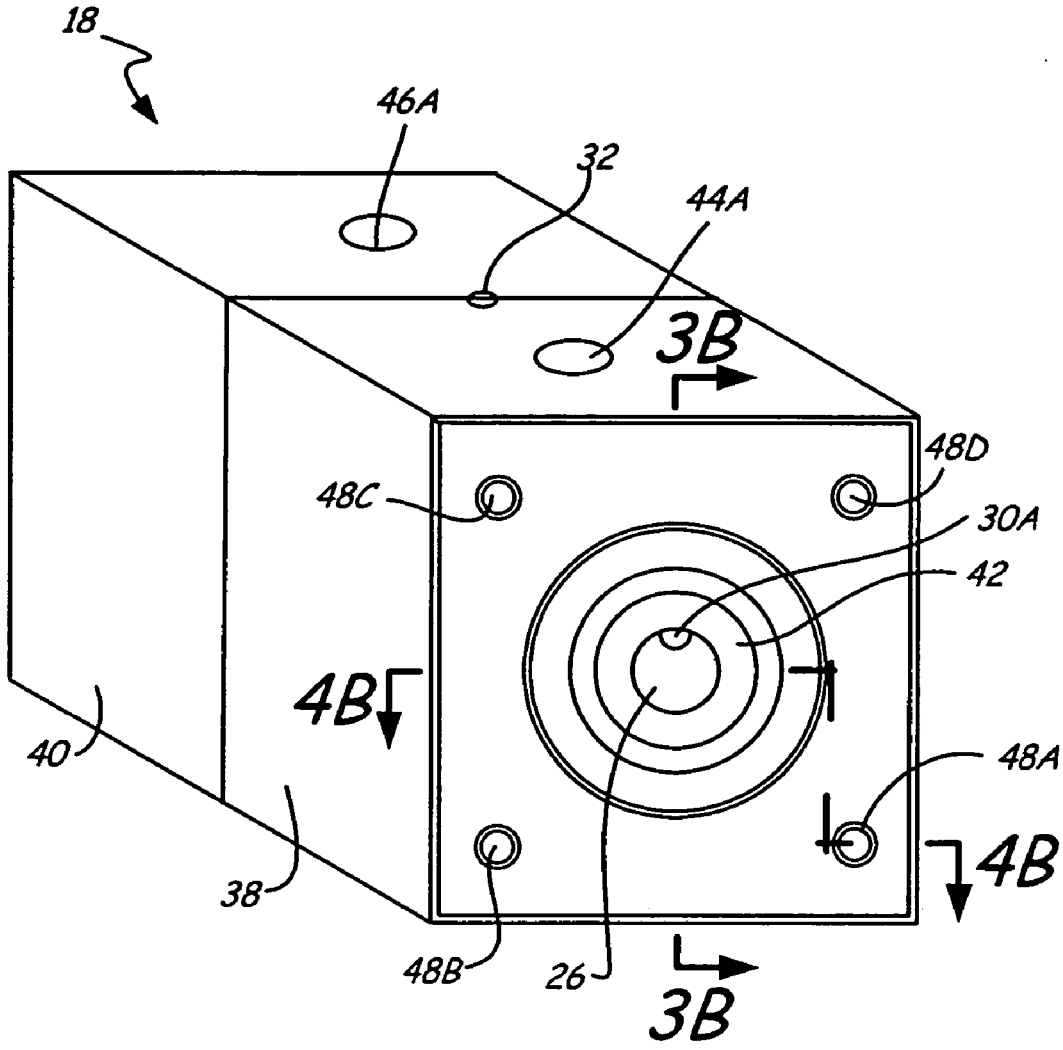
FIG. 2 shows a perspective view of a runner cooling block of the present invention.

FIG. 2 shows a perspective view of runner cooling block 18. Runner cooling block 18 includes bushing block 38 and spreader block 40. Sprue 26 is located inside sprue bushing 42 of bushing block 38. Molten metal enters runner cooling block 18 at sprue 26 through runner 30A and exits at outlet 32. Bushing block 38 includes bushing block water channel 44A, and spreader block 40 includes spreader block water channel 46A. Bushing block water channel 44A and spreader block water channel 46A are used to circulate temperature controlled cooling fluid such as water through runner cooling block 18 in order to regulate the temperature of molten metal flowing through sprue 26 and runner 30A. Bushing block mounting holes 48A–48D are used to couple bushing block 38 to stationary die half 12 with threaded fasteners. FIG. 2 shows cutting plane lines 3B and 4B for sectional views of runner cooling block used in FIGS. 3A, 3B, 4A and 4B, in which the features of the present invention are best described.

Figure 3A:
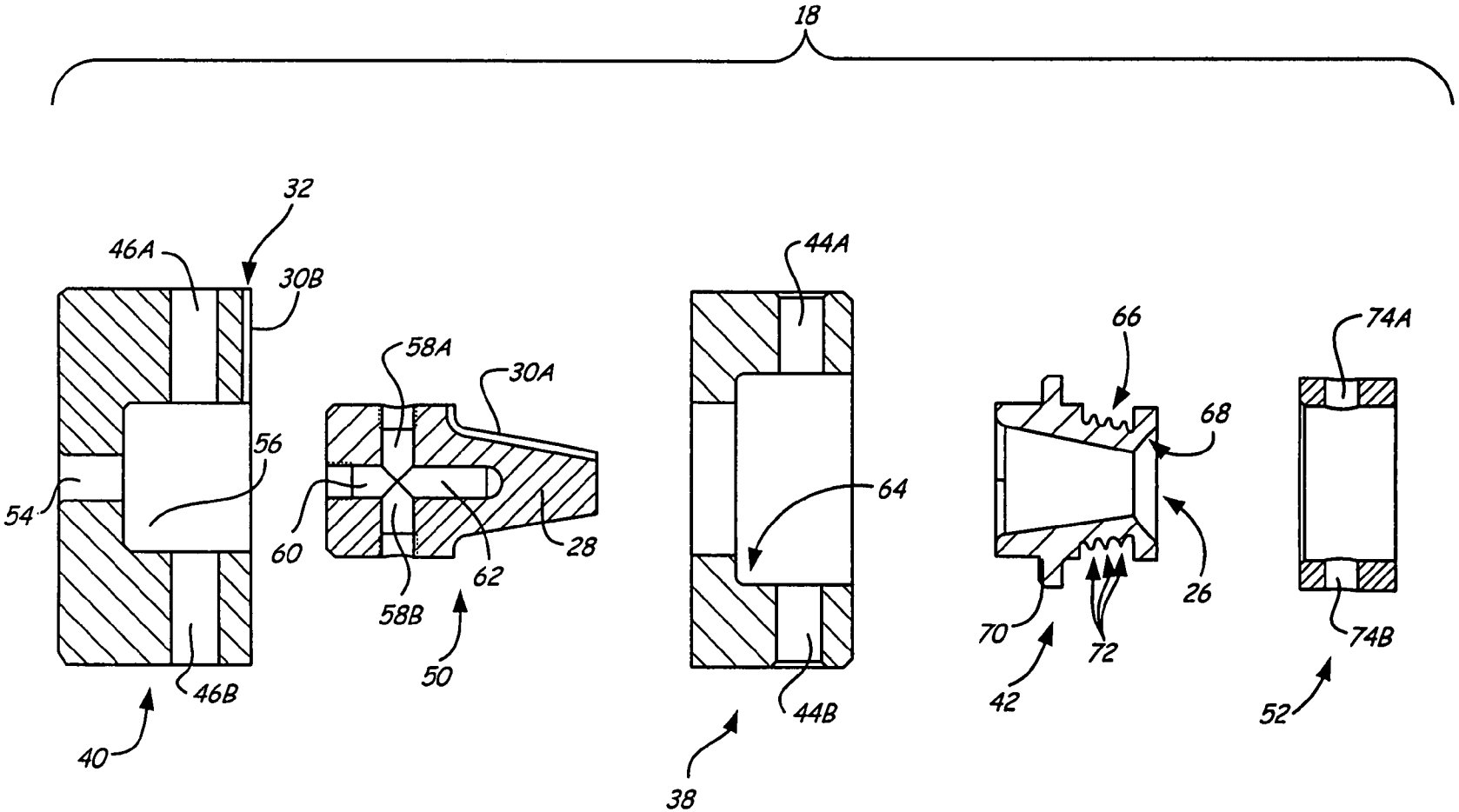
FIG. 3A shows an exploded sectional view of a runner cooling block taken along section 3B—3B of FIG. 2.

FIG. 3A shows an exploded sectional view of runner cooling block 18 taken along section 3B—3B of FIG. 2. Runner cooling block 18 includes spreader block 40, spreader 50, bushing block 38, sprue bushing 42 and water jacket 52.

Spreader block 40 includes runner 30B, which is a small channel that is machined out of spreader block 40. Runner 30B includes outlet 32 at one end and connects with runner 30A at a second end. Molten metal flows through runner 30B on its way to die cavity 16. Spreader block 40 includes spreader block water channels 46A and 46B, and spreader block base water channel 54. Spreader block water channels 46A and 46B, and spreader block base water channel 54 are used to circulate cooling water through spreader 50 in order to control heat transfer between spreader post 28 and the molten metal. Spreader block also includes spreader seat 56, which receives spreader 50 when runner cooling block 18 is assembled.

Spreader 50 includes sprue post 28 and runner 30A. Sprue post 28 is a conventional sprue post type and is used to direct molten metal into the runner system of die casting system 10. Spreader 50 also includes spreader water channels 58A and 58B, spreader base water channel 60 and baffle channel 62. Spreader water channels 58A and 58B, spreader base water channel 60 and baffle channel 62 allow cooling water to be circulated through spreader 50 in order to control heat transfer between spreader post 28 and molten metal flowing through sprue 26.

Bushing block 38 includes bushing block water channels 44A and 44B. Bushing block water channels 44A and 44B are used to circulate cooling water around sprue bushing 42. Bushing block 38 also includes sprue bushing seat 64. Sprue bushing seat 64 receives sprue bushing 42 when runner cooling block 18 is assembled.

Sprue bushing 42 includes sprue 26 and cooling channel 66. Sprue 26 is a channel running through the center of sprue bushing 42 through which molten metal from crucible 20 flows en route to entering die cavity 16. Cooling channel 66 runs circumferentially along the exterior surface of sprue bushing 42 and encircles sprue 26. Cooling water is circulated through cooling channel 66 in order to transfer heat away from sprue bushing 42. Nozzle seat 68 is comprised of a beveled ring surrounding the entrance to sprue 26. Nozzle seat 68 is used to facilitate connection of runner cooling block 18 with nozzle 24 of die casting system 10 or another source of molten metal. Sprue bushing 42 also includes flange 70 for securing sprue bushing 42 inside sprue bushing seat 64.

Cooling channel 66 is shown as a groove cut into the exterior surface of sprue bushing 42. Cooling channel 66 includes circumferential heat transfer contours, such as circumferential fins 72 and circumferential grooves 73. Cooling channel 66 includes a plurality of circumferential fins 72 and a plurality of circumferential grooves 73, which increase the surface area of cooling channel 66. In one embodiment, as shown in FIG. 3A, the plurality of circumferential fins 72 comprises three fins, and the plurality of circumferential grooves 73 comprise four grooves. In other embodiments, circumferential fins 72 comprise a plurality of ribs or projections that run circumferentially around the exterior surface of sprue bushing 42 inside cooling channel 66. The number of circumferential fins 72 and circumferential grooves 73 may vary as needed depending on the particular design requirements of the article to be cast in die chamber 16. In other embodiments, as few as one fin or one channel is used. For each die having a particular die chamber 16, different flow and cooling characteristics of the molten metal are required. Thus, the amount of heat transfer between the molten metal materials and the cooling water is a design requirement and can be controlled using additional or fewer circumferential fins 72 or circumferential grooves 73 to increase the surface area of cooling channel 66. Circumferential fins 72 and circumferential grooves 73 of sprue bushing 42 may be formed with a computer numerical controlled machining system, which accepts digital models of sprue bushing 42, and machines cooling channel 66 and circumferential fins 72 and circumferential grooves 73 directly out of the raw materials used to form sprue bushing 42. Computer numerical controlled systems allow for highly accurate machining of circumferential fins 72 and circumferential grooves 73, which helps control the exact surface area of cooling channel 66.

Preferably, the surface area of cooling channel 66 with circumferential fins 72 and circumferential grooves 73 is at least about 25% greater than a surface area of cooling channel 66 with a substantially smooth surface. More preferably, the surface area of the cooling channel 66 with circumferential fins 72 and circumferential grooves 73 is at least about 50% greater than a surface area of cooling channel 66 with a substantially smooth surface. Even more preferably, the surface area of cooling channel 66 with circumferential fins 72 and circumferential grooves 73 is at least about 100% greater than a surface area of cooling channel 66 with a substantially smooth surface. The increase in surface area of cooling channel 66 improves the heat transfer rate of heated molten metal materials located inside sprue 26 to cooling water circulating inside cooling channel 66 through sprue bushing 42.

Water jacket 52 includes openings 74A and 74B which allow for passage of cooling water from bushing block water channels 44A and 44B to cooling channel 66. Water jacket 52 forms a sealed surface over cooling channel 66 and completely defines the volume of cooling channel 66.

The components of runner cooling block 18, including spreader block 40, bushing block 38, sprue bushing 42, water jacket 52 and spreader 50, can be manufactured from materials with high thermal conductivities, such as tool steels, heat-treated steels, copper, beryllium and/or beryllium-free materials, and combinations thereof. In one embodiment, sprue bushing 42, water jacket 52 and spreader 50 are made of heat treated AISI H-13 steel.

Figure 3B:
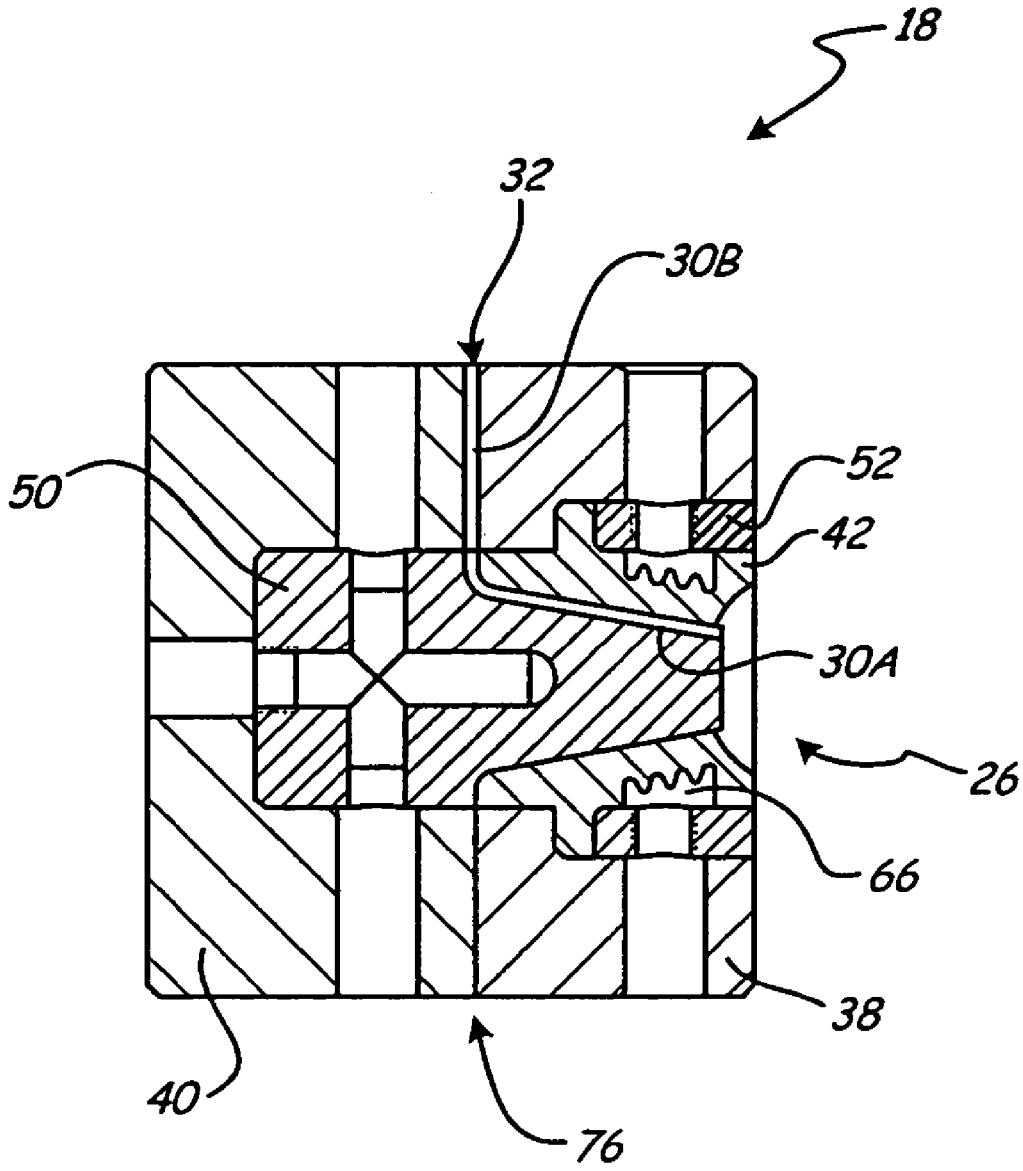
FIG. 3B shows an assembled sectional view of a runner cooling block taken along section 3B—3B of FIG. 2.

FIG. 3B shows an assembled sectional view of runner cooling block 18 taken along section 3B—3B of FIG. 2. During operation of die casting system 10, bushing block 38 and spreader block 40 open and close along interface 76. When closed, molten metal enters runner cooling block 18 through sprue 26. The molten metal then fills runners 30A and 30B. The molten metal exits runner cooling block 18 through outlet 32 and enters die runner 34 of die casting system 10. After a die cast article is molded in die chamber 16, spreader block 40 is pulled away from bushing block 38 along interface 76 when movable die half 14 is pulled away from stationary die half 12. Ejectors 36 (not shown) remove the molded article from die cavity 16 and hardened molten metal remaining in runners 30A and 30B and die runner 34.

Spreader 50 is positioned in spreader seat 56 of spreader block 40. Water jacket 52 is seated on flange 70 of sprue bushing 42. Water jacket 52 is seated against the top of flange 70 such that openings 74A and 74B line up with cooling channel 58. The top of water jacket 54 lines up flush with the top of sprue bushing 52. Cooling channel 66 is thus completely defines by the inner wall of water jacket 52 and the exterior surface of sprue bushing 42.

Sprue bushing 42 and water jacket 52 are bonded together to form a water-tight seal between the two pieces. In one embodiment, sprue bushing 42 and water jacket 52 are bonded together using copper brazing. Copper brazing involves placing copper rings along the interface of sprue bushing 42 and water jacket 52. Sprue bushing 42 and water jacket 52 are then heated to melt the copper, creating a seal at the interface when the copper cools. In one embodiment, the interface between sprue bushing 42 and water jacket 52 may include grooves in which the copper rings are placed. When the copper is heated, it melts and fills in the interface between opposing grooves, thereby improving the water-tight seal when cooled. The brazing between sprue bushing 42 and water jacket 52 is leak tested to ensure the seal can withstand 1800 pounds-per-square-inch of pressure. Once assembled, sprue bushing 42 and water jacket 52 are inserted into sprue bushing seat 64 of bushing block 38. The bottom of flange 70 of sprue bushing 42 sits flush against sprue bushing seat 64.

When sprue bushing 42 and water jacket 52 are positioned in sprue bushing seat 64, sprue bushing water channel 44A and 44B, openings 74A and 74B and cooling channel 66 are aligned to allow for passage of cooling fluid through cooling channel 66 in order to transfer heat from molten metal flowing through sprue 26. In one embodiment, cooling water is circulated through bushing block 38 in a unidirectional manner. In one embodiment, cooling water enters runner cooling block 18 through bushing block water channel 44A, passes through opening 74A, flows into cooling channel 66, flows around sprue 26, enters opening 74B and exits runner cooling block 18 at bushing block water channel 44B.

Sprue bushing 42 absorbs heat from the molten metal flowing through sprue 26. This heat is then absorbed by cooling water circulating through cooling channel 66. The rate of heat transfer between sprue bushing 42, and the circulating cooling water is proportional to the product of the temperature difference and the exposed surface area. Because circumferential fins 72 and grooves 73 of cooling channel 66 increase the surface area of sprue bushing 42 that is exposed to the circulating cooling water, the rate of heat that is transferred from sprue bushing 42 to the circulating cooling water is significantly increased compared to a substantially smooth cooling channel 66. This effectively allows sprue bushing 42 to dissipate a greater amount of heat from the injected metal to the circulating water.

Runner cooling block 18 with circumferential heat transfer contours, such as circumferential fins 72 and circumferential grooves 73, allow for improved heat transfer between molten metal materials entering sprue 26 and cooling water flowing through cooling channel 66. Injected molten metal flowing out of runner cooling block 18 through outlet 32 can then be set to an optimal temperature for flowing through die runner 34, and then rapidly cooling inside die cavity 16. This accordingly reduces the time required for the injected metal to solidify in die cavity 16, which increases efficiency in the die casting system.

Spreader 50 is positioned in runner spreader seat 56 of spreader block 40. When spreader 50 is inserted into seat 56 of spreader block 40, spreader water channels 58A and 58B, spreader base water channel 60 and baffle channel 62 align with spreader block water channels 46A and 46B, and spreader base water channel 54. This allows cooling water to circulate through sprue post 28 in a cascade type, baffle type or other type of cooling manner. The cooling of spreader 50 also assists in dissipating heat from the injected molten metal flowing through sprue 26.

When spreader block 40 is coupled with bushing block 38 inside die casting system 10, sprue post 28 is concentrically located inside sprue 26. There is a small gap between sprue post 28 and sprue 26 of sprue bushing 42, which is not visible in FIGS. 3A–5B. In one embodiment, the gap is approximately 0.030 inches. Additionally, there is also an approximately a 0.030 inch gap between spreader block 40 and bushing block 38. Runner 30A is machined into sprue post 28 and runner 30B is machined into spreader block 40. Runners 30A and 30B are used to connect molten metal flowing from runner sprue 26 with die runner 34 of FIG. 1. The specific size, depth and location of runners 30A and 30B depend on the specific needs as dictated by the requirements of the die and die cavity. Additional runners can also be used.

Figure 4A:
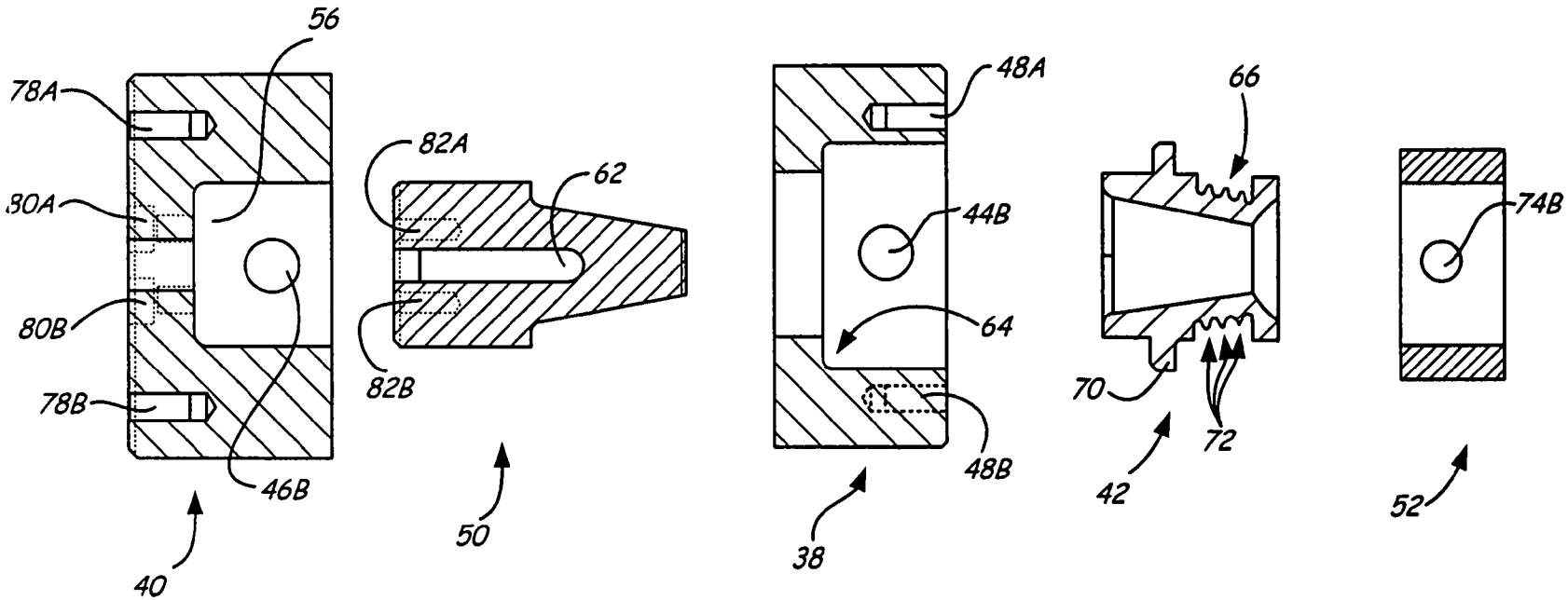
FIG. 4A shows an exploded sectional view of a runner cooling block taken along section 4B—4B of FIG. 2.

FIG. 4A shows an exploded sectional view of runner cooling block 18 taken along section 4B—4B of FIG. 2. Runner cooling block 18 includes spreader block 40, spreader 50, bushing block 38, sprue bushing 42 and water jacket 52. FIG. 4A shows the location of mounting bores used in conjunction with threaded fasteners to secure runner cooling block 18 to die casting system 10. Spreader block 40 includes spreader block mounting bores 78A–78D, of which 78A is shown and 78B is shown in hidden lines. Spreader block 40 also includes spreader mounting holes 80A–80D, of which holes 80A and 80B are shown in hidden lines. Spreader 50 includes spreader mounting bores 82A–82D, of which bores 82A and 82B are shown in hidden lines. Bushing block 38 includes bushing block mounting bores 48A–48D, of which bore 48A is shown and bore 48B is shown in hidden lines.

Figure 4B:
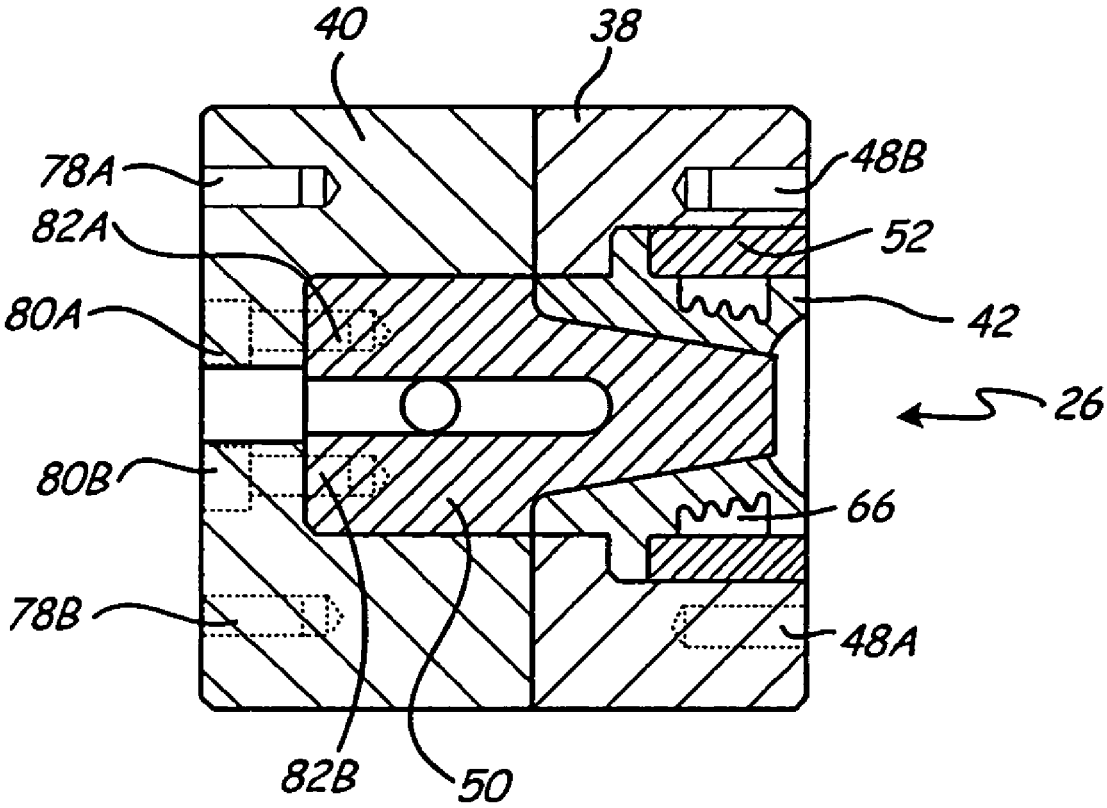
FIG. 4B shows an assembled sectional view of a runner cooling block taken along section 4B—4B of FIG. 2.

FIG. 4B shows an assembled sectional view of runner cooling block 18 taken along section 4B—4B of FIG. 2. Runner cooling block 18 includes spreader block 40, spreader 50, bushing block 38, sprue bushing 42 and water jacket 52. Threaded fasteners are inserted through spreader mounting holes 80A–80D and into spreader mounting bores 82A–82D to fasten spreader 50 to spreader block 40. Spreader block mounting bores 78A–78D receive threaded fasteners that extend from moving die half 14 and are used to secure spreader block 40 to moving half 14. Bushing block mounting bores 48A–48D receive threaded fasteners that extend from stationary die half 12 and are used to secure bushing block 22 to stationary die half 12.

Figure 5A:
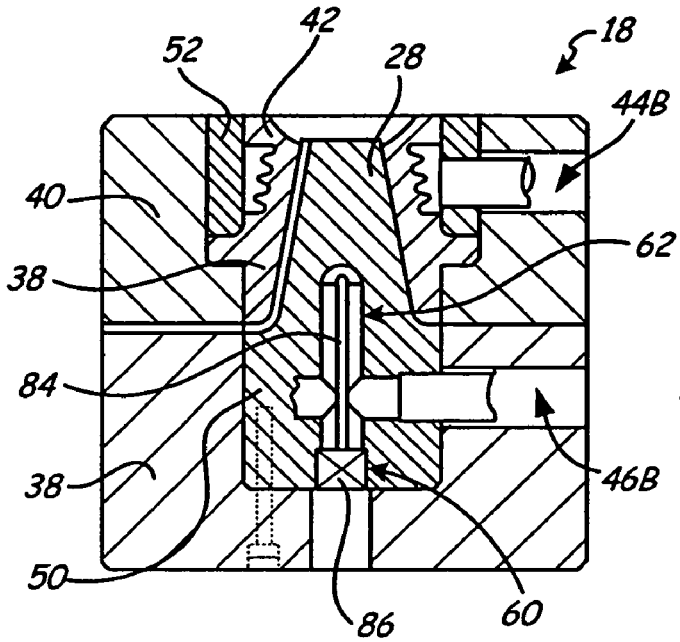
FIG. 5A shows a runner cooling block spreader with baffle type cooling.

FIG. 5A shows spreader 50 with baffle type cooling. Baffle 84 is placed in baffle channel 62 which seals base water channel 60 with plug 86. Cooling water flows in spreader water channel 46B and exits spreader water channel 46A (not shown). Incoming cooling water from spreader water channel 46B is directed into baffle channel 62 by the use of baffle 84. Water flow through baffle channel 62 cools down spreader post 28, which in turn assists in regulating the temperature of molten metal flowing through runner cooling block 18. The cooling water continues around baffle 84 and out the other side of spreader 50 through spreader channel 46A (not shown).

Figure 5B:
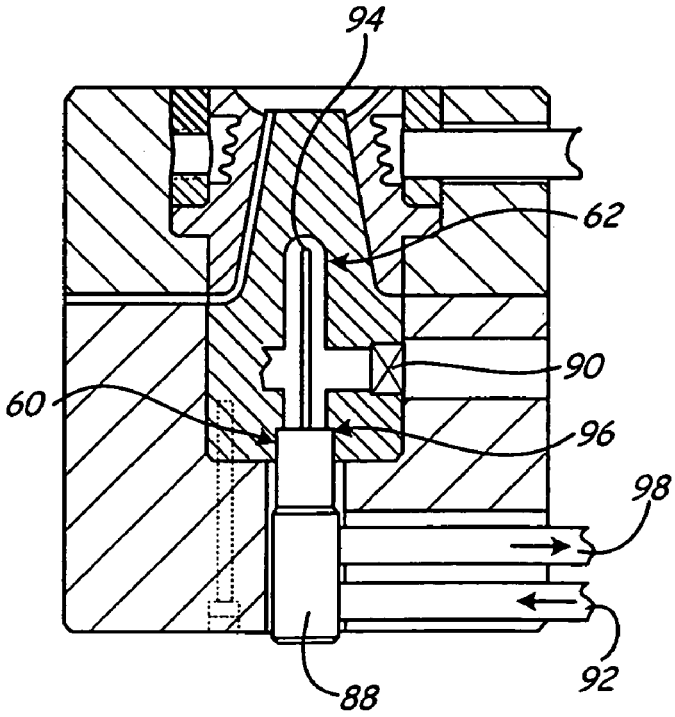
FIG. 5B shows a runner cooling block spreader with cascade type cooling.

FIG. 5B shows a runner spreader with cascade type cooling. A cascade water junction 88 is placed into base water channel 60. Spreader water channel 46B is not used and is sealed up with plug 90. Spreader water channel 46A (not shown) is sealed up in a similar manner. Cooling water flows in base water channel 60 through water junction 88. Cooling water enters through water junction entrance 92 and empties inside baffle channel 62 at water junction tip 94, whereby the cooling water can cool down spreader post 28 in order to assists in regulating the temperature of molten metal flowing through runner cooling block 18. Cooling water returns through water junction return 96 and exits at water junction exit 98.

The relative size of runner cooling block 18 shown in FIGS. 1–5B are exemplary only. Spreader block 40, spreader 50, bushing block 38, sprue bushing 42 and water jacket 52 can be made having various dimensions for use in smaller or larger die casting operations. Smaller dimensioned runner cooling blocks 18 are suitable for a double mold systems, where two runner cooling blocks 18 are disposed next to each other in the die. This allows the cooling of two streams of metal to be injected into a mold, either simultaneously or sequentially. Larger runner cooling blocks can be used for dies requiring a higher throughput of molten metal.

Although the present invention has been described with reference to preferred embodiments, workers skilled in the art will recognize that changes may be made in form and detail without departing from the spirit and scope of the invention.

The invention claimed is:

1. A runner cooling block for use in a die casting system, wherein the runner cooling block receives molten metal for distribution into a runner system of a die and cooling fluid for transferring heat away from the molten metal passing through the runner cooling block, the runner cooling block comprising:

a spreader block having a spreader;

a bushing block having a bushing seat and cooling water access holes;

a sprue bushing comprising:

a sprue channel running through an interior of the sprue bushing;

a cooling channel running circumferentially around an exterior surface of the sprue bushing and having at least one circumferential heat transfer contour; and a water jacket comprising a ring having cooling water holes;

wherein the water jacket is positioned over the cooling channel such that the cooling water holes provide access to the cooling channel, the sprue bushing is situated in the bushing seat such that the access holes, the cooling water holes and the cooling channel are lined up to allow cooling water to pass through the cooling channel, and wherein the spreader block and the bushing block mate such that the spreader is centrally located within the sprue channel wherein molten metal is allowed to pass through the sprue channel for passage into the runner system.

2. The runner cooling block of claim 1 wherein the bushing block, spreader, sprue bushing, water jacket and spreader block are comprised of steel.

3. The runner cooling block of claim 1 wherein the circumferential heat transfer contour is configured to increase a heat transfer rate between materials located in the cooling channel and materials located in the sprue channel.

4. The runner cooling block of claim 1 wherein the circumferential heat transfer contour is configured to increase a surface area of the cooling channel compared with a substantially smooth cooling channel surface.

5. The bushing block of claim 1 wherein the cooling channel includes multiple circumferential heat transfer contours.

6. The bushing block of claim 1 wherein the circumferential heat transfer contour defines a plurality of circumferential grooves.

7. The bushing block of claim 1 wherein the circumferential heat transfer contour defines a plurality of circumferential projections.

8. The bushing block of claim 5 wherein the circumferential heat transfer contour increases a surface area of the cooling channel by at least about 25 percent compared with a substantially smooth cooling channel surface.

9. The bushing block of claim 8 wherein the circumferential heat transfer contour increases a surface area of the cooling channel by at least about 50 percent compared with a substantially smooth cooling channel surface.

10. The bushing block of claim 9 wherein the circumferential heat transfer contour increases a surface area of the cooling channel by at least about 100 percent compared with a substantially smooth cooling channel surface.

* * * * *